US007250102B2

(12) United States Patent
Fischer

(10) Patent No.: US 7,250,102 B2
(45) Date of Patent: Jul. 31, 2007

(54) ALUMINIUM ELECTROPLATING FORMULATIONS

(75) Inventor: Juergen K. S. Fischer, Minneapolis, MN (US)

(73) Assignee: Alumiplate Incorporated, Minneapolis, MN (US)

( * ) Notice: Subject to any disclaimer, the term of this patent is extended or adjusted under 35 U.S.C. 154(b) by 373 days.

(21) Appl. No.: 10/476,220

(22) PCT Filed: Apr. 30, 2002

(86) PCT No.: PCT/US02/13832

§ 371 (c)(1),
(2), (4) Date: Oct. 28, 2003

(87) PCT Pub. No.: WO02/088434

PCT Pub. Date: Nov. 7, 2002

(65) Prior Publication Data

US 2004/0140220 A1 Jul. 22, 2004

(51) Int. Cl.
*C25D 3/44* (2006.01)

(52) U.S. Cl. ..... 205/237

(58) Field of Classification Search ..... 205/237
See application file for complete search history.

(56) References Cited

U.S. PATENT DOCUMENTS

| | | | |
|---|---|---|---|
| 2,849,349 A | 8/1958 | Ziegler et al. | |
| 3,234,114 A | 2/1966 | Ziegler et al. | |
| 4,417,954 A | 11/1983 | Birkle et al. | |
| 4,948,475 A | 8/1990 | Doetzer et al. | |
| 5,007,991 A | 4/1991 | Lehmkuhl et al. | |
| 5,091,063 A | 2/1992 | Lehmkuhl et al. | |
| 6,207,036 B1 * | 3/2001 | de Vries | 205/237 |

FOREIGN PATENT DOCUMENTS

| | | |
|---|---|---|
| DE | 19855666 | 8/2000 |
| EP | 0505886 | 9/1992 |
| WO | WO 9823795 | 4/1998 |

OTHER PUBLICATIONS

"The Principles and Techniques of Electrolytic Aluminum Deposition and Dissolution in Organoaluminum Electrolytes", Lehmkuhl et al. *Advances in Eletrochemical Science and Engineering*, vol. 3, pp. 165-221 (1994).

* cited by examiner

*Primary Examiner*—Roy King
*Assistant Examiner*—William T. Leader
(74) *Attorney, Agent, or Firm*—Campbell Nelson Whipps, LLC

(57) ABSTRACT

Electroplating electrolyte compositions including CA•(nAl$(C_3H_7)_3$(2−n)$AlR_3$) where n is 0 and less than or equal to 2; C is Li, Na, K, Rb, Cs, $NR'_4$, or mixtures thereof wherein R' is H, $CH_3$, $C_2H_5$, $C_3H_7$, $C_4H_9$, $C_5H_{11}$, $C_6H_{13}$, $C_7H_{15}$, $C_8H_{17}$, or mixtures thereof; A is H, F, Cl, Br, or mixtures thereof; R is H, halogen, $CH_3$, $C_2H_5$, $C_3H_7$, $C_4H_9$, $C_5H_{11}$, $C_6H_{13}$, $C_7H_{15}$, $C_8H_{17}$, or mixtures thereof; and an aromatic hydrocarbon, aliphatic hydrocarbon, or mixtures thereof are described. Aluminum and magnesium/aluminum electroplating compositions including C•(nAl$(C_3H_7)_4$(1−n)$AlR_4$) where n is 0 and less than or equal to 1, where C is a cation such as, li, Na, K, Rb, Cs, or mixtures thereof; R is H or an alkyl such as, $CH_3$, $C_2H_5$, $C_3H_7$, $C_4H_9$, $C_5H_{11}$, $C_6H_{13}$, $C_7H_{15}$, $C_8H_{17}$, or mixtures thereof are also described. The aluminum and magnesium/aluminum electroplating compositions formulation can include a solvent such as, an aromatic hydrocarbon, aliphatic hydrocarbon, or mixtures thereof.

13 Claims, 5 Drawing Sheets

ALUMINIUM ELECTROPLATING FORMULATIONS

BACKGROUND OF THE INVENTION

The invention relates generally to the field of electroplating and more specifically to aluminum and magnesium/aluminum electroplating.

The science of electroplating has been developed over a number of years, beginning perhaps with Ziegler et al., U.S. Pat. No. 2,849,349. This patent is hereby incorporated in its entirety by reference herein. Lehmkuhl et al., U.S. Pat. Nos. 5,007,991 and 5,091,063, and Birkle et al., U.S. Pat. No. 4,417,954 likewise are incorporated in their entirety by reference herein.

While electroplating is not a new art, possible advances remain. Areas of possible improvement include, for example, throwing power and current density. Throwing power refers to the ability of an electroplating solution to deposit metal uniformly on an irregularly shaped object. Current density refers to the electrical current (amp/$dm^2$) that can be applied across the anode and the cathode during the electroplating process.

SUMMARY OF THE INVENTION

Aluminum electroplating electrolyte compositions include $CA\bullet(nAl(C_3H_7)_3(2-n)AlR_3)$ where n is greater than 0 and less than or equal to 2; C is Li, Na, K, Rb, Cs, $NR'_4$, or mixtures thereof wherein R' is H, $C_1$-$C_8$ alkyl, e.g., $CH_3$, $C_2H_5$, $C_3H_7$, $C_4H_9$, $C_5H_{11}$, $C_6H_{13}$, $C_7H_{15}$, $C_8H_{17}$, or mixtures thereof; A is H, F, Cl, Br, or mixtures thereof; R is H, $C_1$-$C_8$ alkyl, e.g., $CH_3$, $C_2H_5$, $C_3H_7$, $C_4H_9$, $C_5H_{11}$, $C_6H_{13}$, $C_7H_{15}$, $C_8H_{17}$, or mixtures thereof; and an aromatic hydrocarbon, aliphatic hydrocarbon, or mixtures thereof.

The above aluminum electrolyte composition of the above-identified formula also includes embodiments where n is from 0 to 2 when such aluminum electrolyte compositions are in admixture with other aluminum alkyls, ethers, alkoxy-aluminum alkyls, aluminoxanes, or mixtures thereof.

Aluminum and magnesium/aluminum electroplating compositions include $C\bullet(nAl(C_3H_7)_4(1-n)AlR_4)$ where n is from 0 to 1. C is a cation such as, Li, Na, K, Rb, Cs, or mixtures thereof. R is H or an alkyl such as, $CH_3$, $C_2H_5$, $C_3H_7$, $C_4H_9$, $C_5H_{11}$, $C_6H_{13}$, $C_7H_{15}$, $C_8H_{17}$, or mixtures thereof. The aluminum magnesium/aluminum electroplating compositions formulation can include a solvent such as, an aromatic hydrocarbon, aliphatic hydrocarbon, or mixtures thereof.

DETAILED DESCRIPTION

The term "about" is presumed to modify all numeric values, whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

The term "M" is molar amount commonly used in chemistry. The formulation examples and claims report values for concentrations in mol per mol salt or mol per mol cation.

Figure 1:
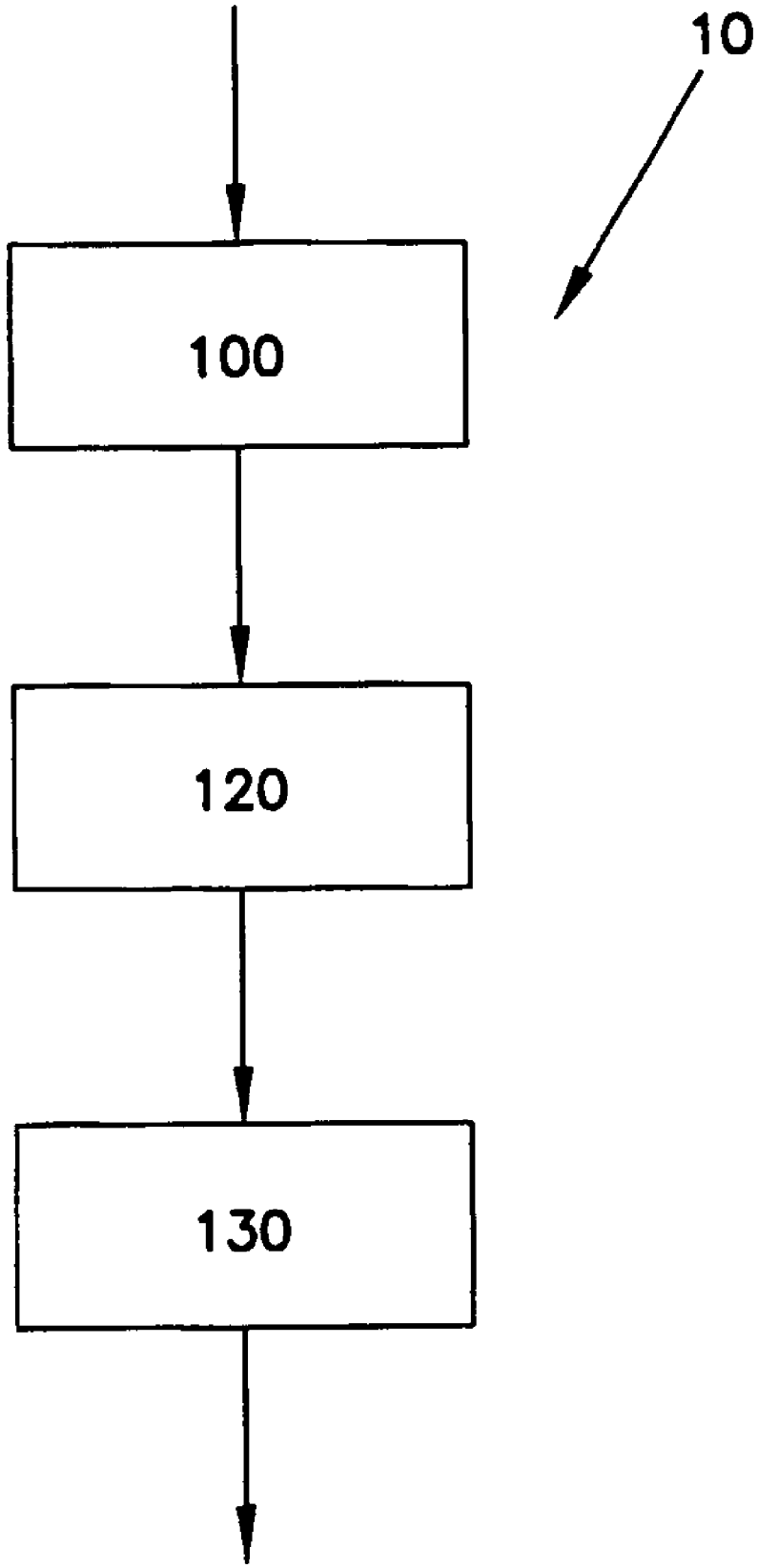
FIG. 1 is a flow diagram of an electroplating process.

FIG. 1 is a flow diagram of an electroplating process. A base metal enters the electroplating process 10 at a pre-treatment step 100. The base metal can be any material that can be plated with aluminum, magnesium, aluminum/magnesium or the like. The pre-treatment step prepares the base metal for plating by removing any non-base metal impurities from the base metal. The pre-treated base metal proceeds to a plating process 120. The plating process 120 plates the base metal with aluminum, magnesium, aluminum/magnesium or the like. The plated base metal proceeds to a post-treatment process 130. The post-treatment process 130 prepares the plated base metal for further process such as, for example, drying, application of conversion coatings, lubrication, sealers and the like. The pre-treatment, plating and post-treatment processes can take place in an inert atmosphere or under vacuum.

Pre-treatment

Pre-treatment provides a clean surface on the piece or base metal to be coated. To remove fat, oxides, and other impurities from the surface, degreasing, etching, and/or descaling operations are carried out. Each treatment step is followed by one or more rinsing steps and conducted in such a manner as to minimize loss and to recycle valuable material.

Figure 2:
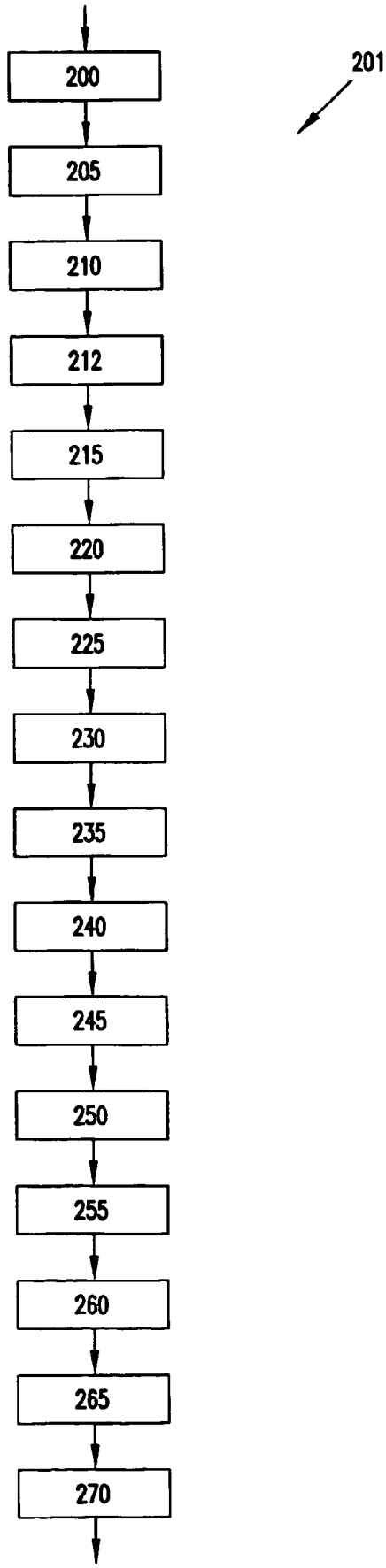
FIG. 2 is a flow diagram of a pre-treatment process shown as box 100 in FIG. 1.

FIG. 2 is a flow diagram of a pre-treatment process shown as box 100 in FIG. 1. The base metal enters the pre-treatment process 201 at degreasing 200. Degreasing 200 removes grease and the like from the base metal. Degreasing solutions can include surfactants or other degreasing materials. The degreased base metal proceeds to a water rinse 205. The water rinse 205 removes the degreasing solution from the degreased base metal.

The rinsed and degreased base metal proceeds to an electrolytic degreasing 210 to further degrease the base metal. The further degreased base metal proceeds to a water rinse 212. The further degreased and rinsed base metal proceeds to an acid etch 215 to remove oxides from the base metal. The acid may be any acid capable of removing oxides from the base metal. The acid etched base metal proceeds to a water rinse 220 to remove any remaining acid from the base metal.

The etched base metal then can be nickel plated 225. The nickel plating thickness can be 2 micrometers. The nickel plated base metal can be water rinsed 230 and dried 235.

The dried nickel-plated base metal enters an air lock 240 and vacuum environment. The plated base metal proceeds to an activation bath 245. The activation bath 245 can include an aqueous inorganic acid in aliphatic mono- or di- or tri-hydric alcohol. The inorganic acid may be hydrofluoric acid and the alcohol can be ethylene glycol, for example. The composition of the activation bath 245 must be compatible with the base metal.

The activated base metal proceeds to an intermediate rinse 250. The intermediate rinse 250 includes a material that is soluble with the later electrolyte solvent. The intermediate rinse 250 can be an aliphatic alcohol such as, for example, diethylene glycol monomethyl ether or a mixture of the electrolyte solvent with an aliphatic alcohol such as, for example, toluene and di-ethylene glycol monomethyl ether.

A first electrolyte solvent rinse 255 removes remaining intermediate rinse material. The first electrolyte solvent rinse 255 can include up to 10% of the aliphatic alcohol used in the intermediate rinse as impurity. A second electrolyte solvent rinse 260 further removes intermediate rinse material. The second electrolyte solvent rinse 260 can include up to 1% of the aliphatic alcohol used in the intermediate rinse as impurity. A third electrolyte solvent rinse 265 further removes intermediate rinse material. The third electrolyte solvent rinse 265 can include up to 0.1% of the aliphatic alcohol used in the intermediate rinse as impurity.

The base metal rinsed with the electrolyte solvent can proceed to an electroplating process 270.

Plasma Etch Pre-Treatment

Figure 3:
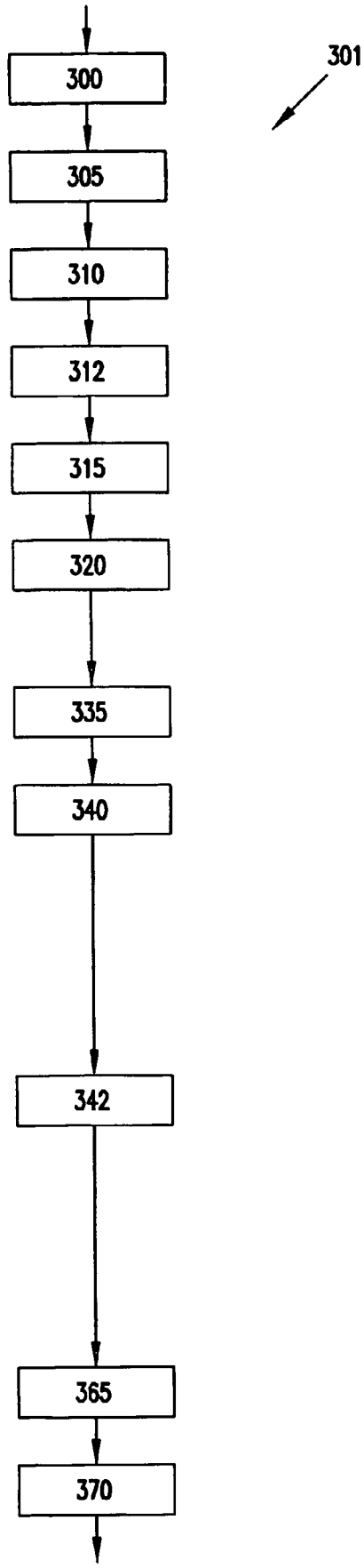
FIG. 3 is a flow diagram of the pre-treatment process shown in FIG. 2 where a plasma etch is used.

FIG. 3 is a flow diagram of the pretreatment process shown in FIG. 2 where a plasma etch is used to remove impurities from greasy and heavily oxidized base metal.

The base metal enters the pre-treatment process 301 at degreasing 300. Degreasing 300 removes grease and the like from the base metal. Degreasing solutions can include surfactants or other degreasing materials. The degreased base metal proceeds to a water rinse 305. The water rinse 305 removes the degreasing solution from the degreased base metal.

The rinsed and degreased base metal proceeds to an electrolytic degreasing 310 to further degrease the base metal. The further degreased base metal proceeds to a water rinse 312. The further degreased and rinsed base metal proceeds to an acid etch 315 to remove oxides from the base metal. The acid may be any acid capable of removing oxides from the base metal. The acid etched base metal proceeds to a water rinse 320 to remove any remaining acid from the base metal and dried 335.

The dried acid etched base metal enters an air lock 340 and vacuum environment. In the vacuum environment, the acid etched base metal can be plasma etched 342 to remove further impurities from the base metal. The plasma etch 342 is an aprotic robust process capable of processing a wide variety of materials. The plasma etch 342 bombards the base metal with charged particles. The charged particles strike the base metal and "knock off" organic and inorganic impurities from the base metal surface. The plasma etch pre-treatment process 301 could eliminate multiple steps, and associated chemical, recycling and waste treatment costs, from the normal pre-treatment process 201.

A solvent rinse 365 follows the plasma etch 342 to remove dust from the metal surface to be plated. The solvent rinsed base metal can proceed to an electroplating process 370. If the base metal is only slightly greasy and slightly oxidized, it is possible to use the pretreatment process 301 shown in FIG. 3. The parts enter without aqueous pretreatment immediately the airlock 340 and vacuum environment. After plasma etch 342 the parts can proceed to an electroplating process 370 directly or after a rinse in a solvent 365. The plasma etch pretreatment described in FIG. 3 is an aprotic process like the Al-plating and the Mg/Al-plating itself. The whole process with plasma etch as pretreatment and plating is totally aprotic and this means it is 100% safe not to introduce hydrogen embrittlement. This is especially important for plating high strength steel for flight sensitive parts.

Electrolyte Formulations

The electrolyte formulations described herein are useful for aluminum, and magnesium/aluminum electroplating. Several factors impact electrolyte development, such as, for example, electrolyte cost, technical and safety concerns, and plating performance.

Cost concerns include, for example, costs of chemicals required during electrolyte lifetime, costs for electrolyte recycling, costs for waste disposal and the electrolyte lifetime.

Technical and safety concerns include, for example, low chemical toxicity, low chemical pyrophoricity, low vapor pressure of the electrolyte solvent at plating temperature and minimal crystallization disturbance.

Plating performance concerns include, for example, high throwing power and covering power, high maximum current density on a part, 100% anodic current efficiency, 100% cathodic current efficiency (forming a pure aluminum layer) and forming a porefree, dense aluminum layer with an appealing visual appearance.

The inventive electrolyte formulations provide improved throwing power and improved current density. In particular, the electrolyte formulations are useful in electroplating base materials with either aluminum or a combination of aluminum and magnesium and the like.

Processing

Electroplating may be accomplished with direct current. Direct current provides a current density that is limited since as the current density increases the alkali metal (i.e. potassium, etc.) precipitates together with aluminum on the base metal, which decreases the life of the electrolyte and changes the corrosion resistance of the plating layer on the base metal.

Electroplating may be accomplished at least in part by pulse reverse plating. Pulse reverse plating is a method of electroplating where the electroplating current is periodically reversed. Forward current pulse time can be 30 to 150% of the time required to put one layer of aluminum atoms onto the base metal. Reverse current pulse time can be 1.5 to 5% of the time of the forward current pulse time. Peak reverse current can be 50 to 200% of peak forward current. Periodic pulse reverse current can increase the effective current forward (effective current density) if the periodic pulse reverse current is optimized. If an electrolyte has 1 $A/dm^2$ maximum current density with direct current, an optimized periodic pulse reverse current can have the following properties:

forward current: reverse current of 50:2 ms/ms peak forward current: peak reverse current ratio of 1:1

The optimized periodic pulse reverse current produced an optimized effective current density of 1.2 $A/dm^2$. Thus, the optimized periodic pulse reverse current produced an effective plating current density 20% greater than a direct current process.

The optimized periodic pulse reverse plating produces plated base metal with equal to or better physical properties for micro hardness, purity of plated layer, evenness of the plating (throwing power), roughness and visual appearance than the optimized direct current plating.

Aluminum Electroplating Formulations

The inventive electrolyte formulations can include a solvent, a salt, an aluminum alkyl and optional enhancers or additions. The mole ratio of aluminum alkyl to salt may be 2:1.

Solvent

The solvent can be any aromatic or aliphatic hydrocarbon such as, for example, benzene, toluene, xylene, meta-xylene, cumene, diphenylmethane, para-isopropyl-methylbenzene, tetralin, ethylbenzene, anisole, dipropylether, diisoproplyether, dibutylether, tetrahydrofuran, and the like.

Salt for 2:1 Complex

The salt is formed by a cation and an anion. The cation may be an alkali metal, such as, for example, lithium, sodium, potassium, rubidium, caesium and the like or the cation may be a tetrammonium, and the like. The anion may be a halogen, such as, fluoride, chloride, bromide and the like or the anion may be an straight or branched, substituted or unsubstituted alkyl, such as, for example, methyl, ethyl, propyl, butyl, and the like. The anion may also be a hydride.

Al-alkyls for 2:1 Complex

Aluminum alkyls can be illustrated as $R^1AlR_2$ where R is hydrogen, halogen or a 1-8 carbon straight or branched chain alkyl, such as, for example, methyl, ethyl, n-propyl, isopropyl, n-butyl, iso-butyl, pentyl, hexyl, heptyl, octyl, and the like and where $R^1$ is a 1-8 carbon straight or branched chain alkyl, such as, for example, methyl, ethyl, n-propyl, isopropyl, n-butyl, iso-butyl, pentyl, hexyl, heptyl, octyl, and the like.

Tri-propyl-aluminum (TPA) has a thermal stability that is higher than most other aluminum alkyls. The 2:1 TPA complexes have a high solubility and a high decomposition voltage, which makes TPA a useful component in electrolytes for aluminum plating. High plating temperatures, high concentrations and high maximum current densities can be used with formulations that include TPA.

TPA formulations can be expressed as:

$$CA\bullet(nAl(C_3H_7)_3(2-n)AlR_3)$$

where n is greater than 0 and less than or equal to 2. C is a cation such as, Li, Na, K, Rb, Cs, $NR'_4$, or mixtures thereof where R' is a $C_1$-$C_8$ alkyl, e.g., $CH_3$, $C_2H_5$, $C_3H_7$, $C_4H_9$, $C_5H_{11}$, $C_6H_{13}$, $C_7H_{15}$, $C_8H_{17}$, or mixtures thereof. A is an anion such as, H, F, Cl, Br, or mixtures thereof. R is H, halogen, or an alkyl such as, $CH_3$, $C_2H_5$, $C_3H_7$, $C_4H_9$, $C_5H_{11}$, $C_6H_{13}$, $C_7H_{15}$, $C_8H_{17}$, or mixtures thereof. The TPA formulation can include a solvent such as, an aromatic hydrocarbon, aliphatic hydrocarbon, or mixtures thereof. TPA complex formulations can include solvent and optionally an addition.

When n is equal to 0 (no TPA present in complex), the electrolyte includes the 2:1 complex, a solvent and an addition. Additions are described below.

Aluminum and Magnesium/Aluminum Electroplating Formulations

The inventive electrolyte formulations can include a solvent, a salt, an aluminum alkyl and optional enhancers or additions. The mole ratio of aluminum alkyl to salt may be 1:1.

Solvent

The solvent can be any aromatic or aliphatic hydrocarbon such as, for example, benzene, toluene, xylene, meta-xylene, cumene, diphenylmethane, para-isopropyl-methylbenzene, tetralin, ethylbenzene, anisole, dipropylether, diisoproplyether, dibutylether, tetrahydrofuran, and the like.

Cation for 1:1 Complex

The cation may be an alkali metal, such as, for example, lithium, sodium, potassium, rubidium, caesium, magnesium and the like.

Anion for 1:1 Complex

The anion may be an aluminum alkyl. Aluminum alkyl anions can be illustrated as $AlR^6_4$ where $R^6$ is hydrogen or a 1-8 carbon straight or branched chain alkyl, such as, for example, methyl, ethyl, n-propyl, isopropyl, n-butyl, iso-butyl, pentyl, hexyl, heptyl, octyl and the like.

Quad-propyl-aluminum (QPA) has a thermal stability that is higher than most other aluminum alkyls. The 1:1 QPA complexes have a high solubility and a high decomposition voltage, which makes QPA a useful component in electrolytes for aluminum and magnesium/aluminum plating. High plating temperatures, high concentrations and high maximum current densities can be used with formulations that include QPA.

QPA formulations can be expressed as:

$$C^1\bullet(nAl(C_3H_7)_4(1-n)AlR^7_4)$$

where n is from 0 to 1. $C^1$ is a cation such as, Li, Na, K, Rb, Cs, or mixtures thereof. $R^7$ is H or an alkyl such as, $CH_3$, $C_2H_5$, $C_3H_7$, $C_4H_5$, $C_5H_9$, $C_6H_{11}$, $C_7H_{13}$, $C_8H_{17}$, or mixtures thereof. The QPA formulation can include a solvent such as, an aromatic hydrocarbon, aliphatic hydrocarbon, or mixtures thereof. QPA complex formulations can include solvent and optionally an addition.

QPA formulations can include the following:

$$C^1\bullet(AlR^7_4) \text{ and}$$

$$C^1\bullet(AlR^7_3\text{—}H\text{—}AlR^7_3)$$

or mixtures thereof. $C^1$ is a cation such as, Li, Na, K, Rb, Cs, or mixtures thereof. $R^7$ is H, or an alkyl such as, $CH_3$, $C_2H_5$, $C_3H_7$, $C_4H_9$, $C_5H_{11}$, $C_6H_{13}$, $C_7H_{15}$, $C_8H_{17}$, or mixtures thereof.

When magnesium/aluminum formulations are used, these electrolytes plate aluminum/magnesium alloys onto conductive substrates or base metals using magnesium and aluminum anodes or anodes made out of magnesium/aluminum alloy with the same or similar composition as the desired plating material. Also, these magnesium/aluminum formulations are used to dummy plate with aluminum/magnesium alloy anodes or magnesium anodes to reach the concentration of magnesium alkyls in the electrolyte required for the magnesium/aluminum alloy plating.

Additions

Aluminum alkyls can be added to the aluminum and magnesium/aluminum formulations defined above including embodiments where n is 0 in an amount in excess of the 2 moles of aluminum alkyl to one mole of salt forming the 2:1 complex. Adding aluminum alkyls in excess can enhance the current density physical property of the formulation. Aluminum alkyls can be illustrated as $R^1AlR^2$ where $R^2$ is hydrogen, halogen, or a 1-8 carbon straight or branched chain alkyl, such as, for example, methyl, ethyl, n-propyl, isopropyl, n-butyl, iso-butyl, pentyl, hexyl, heptyl, octyl, and the like and $R^1$ is a 1-8 carbon straight or branched chain alkyl, such as, for example, methyl, ethyl, n-propyl, isopropyl, n-butyl, iso-butyl, pentyl, hexyl, heptyl, octyl, and the like.

Ethers may be added to the formulations, as with aluminum alkyls, to improve the throwing power physical property of the formulation. The ether can be aliphatic or aromatic. Aliphatic ether may include straight chain or cyclic ethers, for example, dimethylether, ethylene glycol diether, dioxane, tetrahydrofuran, and the like. Aromatic ethers can include, for example, anisole and the like.

Aluminum alkyls may react with trace amounts of oxygen and/or water to form aluminoxanes and/or alkoxy-compounds. These compounds may be provided in the formulation via electrolyte recycle streams. These compounds can enhance the physical properties of the formulation. Alkoxy-compounds can be illustrated as $R^5_pAl(OR^5)_{3-p}$ where p is 0, 1 or 2 and $R^5$ is a 1-8 carbon straight or branched chain alkyl, such as, for example, methyl, ethyl, n-propyl, isopropyl, n-butyl, iso-butyl, pentyl, hexyl, heptyl, octyl and the like. Alkoxy-aluminum-alkyls may include $R^{25}Al—O—(C_2H_4—O—)_q—Al—R_2^5$ or $R_2^5Al—O—(C_2H_4—O—)_q—R^5$ or the like where q is 0, 1, 2, 3, or 4. Aluminoxanes can be illustrated as $R^4{}_2Al—(O—AlR^4{}_2)_m—OAlR^4{}_2$ or $(R^4AlO)_n$ where m is an integer from 1-8, n is an integer from 3 to 8, and $R^4$ is a 1-8 carbon straight or branched chain alkyl, such as, for example, methyl, ethyl, n-propyl, isopropyl, n-butyl, iso-butyl, pentyl, hexyl, heptyl, octyl and the like. The compound of the formula $(R^4AlO)_n$ is a ring structured compound; for example, when n is 3 the compound has the structure

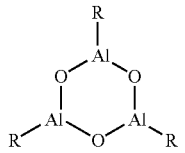

Particular electrolyte formulations can provide significant advances in current density and throwing power. Some formulations are directed to enhancing throwing power, while others are directed to improving current density or solubility of the complex. Some formulations provide an attractive balance between throwing power and current density. Examples 1-4 illustrate useful formulations.

Electrolyte Recycling

Several improved electrolyte recycling procedures are outlined below. In the first procedure,

- Take the old/used electrolyte and evaporate a portion of the solvent. A portion of the alkoxy compounds will evaporate with the solvent.
- Cool and crystallize part of the mixture and then separate the alumioxane in the solution and complexes such as crystalline KF*2TEA.
- Use of the complex crystals like KF*2TEA along with some impurities to create new electrolyte. The impurities are important as they simplify the separation process and can be used as addition to the new electrolyte charge. Alternatively,
- Take the old electrolyte and completely evaporate the solvent and the alkoxy compounds.
- Cool and crystallize the mixture.
- Dissolve the aluminoxanes with ether or an aliphate ($C_5H_{12}$ to $C_{12}H_{26}$).
- Separate the dissolved aluminoxanes and solid complexes such as KF*2TEA.
- Use the complex like KF*2TEA along with some impurities to create new electrolyte. The impurities are important as they simplify the separation process and can be used as addition to increase solubility and throwing power of the electrolyte.
- Evaporate the remaining ether or the aliphatic solvent on the crystals.
- Add the solvent for the electrolyte and dissolve the complex.

Blower System

Figure 4:
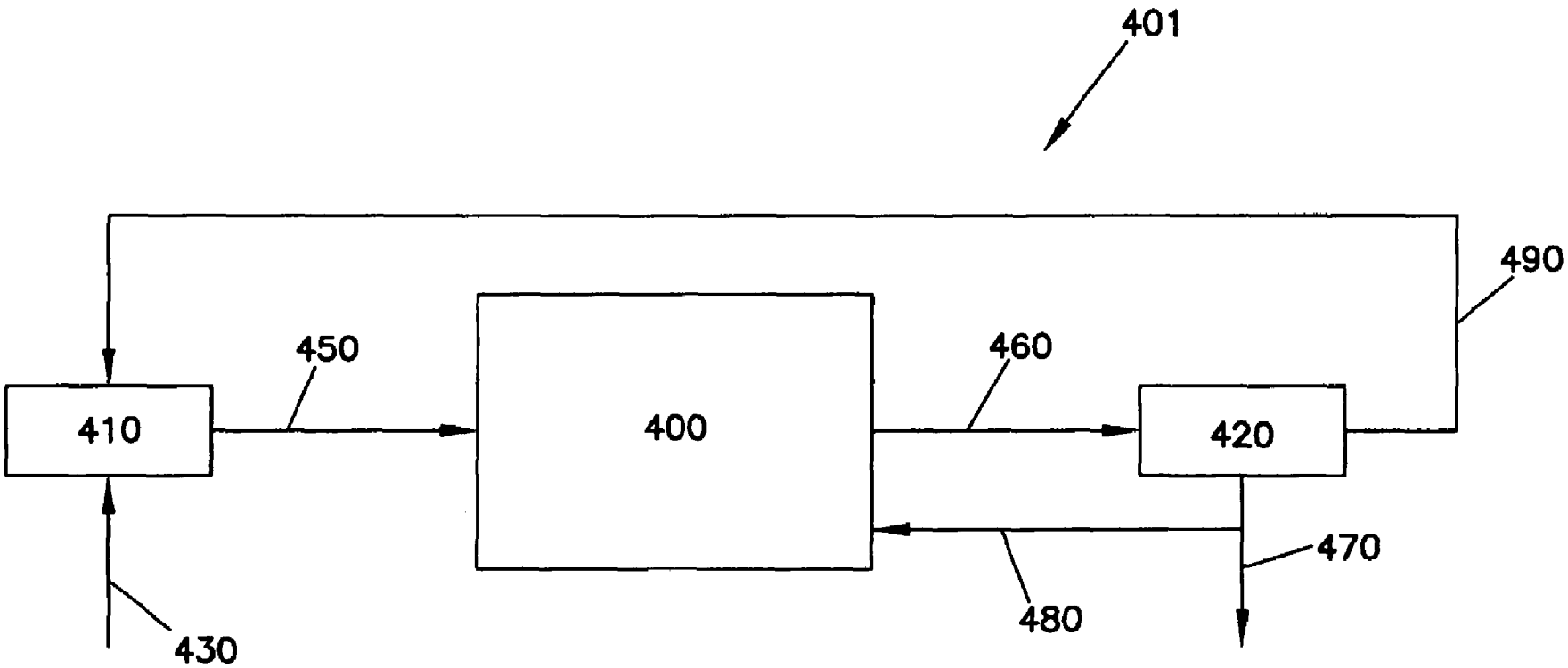
FIG. 4 is a flow diagram of a blower system for an electroplating process.

FIG. 4 is a flow diagram of a blower system for an electroplating process. The blower system 401 includes a blower 410 for forcing gas through the electroplating process 400. The blower 410 provides gas to the electroplating process 400 via an exhaust conduit 450. The gas exits the electroplating process 400 via an exit conduit 460. The gas may pass through a condenser 420. The condenser 420 removes energy from the gas and condenses liquid that can be removed from the blower system 401 via a condensate exit conduit 470 or the condensate can be recycled to the process 400 via a condensate return conduit 480. The gas may be recycled to the blower 410 via a gas recycle conduit 490.

The blower system 401 removes volatile electrolyte impurities such as, for example, $AlR_2OC_2H_5$ where R is previously defined. The blower system 401 provides electrolyte bath agitation for the plating process. The blower system 401 provides cooling to the electroplating bath to prevent overheating of the electrolyte during plating. The blower system 401 provides continuous recycling of rinse solvents such as toluene since the condensate may contain higher concentrations of rinse solvent versus the used outlet rinse bath solution. The outlet rinse bath is the rinse bath used after plating to rinse off electrolyte with the electrolyte solvent from the plated parts.

Humidity can be added to the blower system 401 at a humidity intake conduit 430. Humidity may be added to the system prior to opening up the system for maintenance. The liquid can be drained from the electroplating process 400, however pyrophoric material and combustible solvent may remain. Humidity forced through the blower system 401 can destroy this pyrophoric material and the solvent can be condensed and removed from the system 400 before air is admitted into the electroplating process during maintenance. Thus, the blower system 401 can provide an important safety function to the electroplating process 400.

Bulk Plating Device

Figure 5:
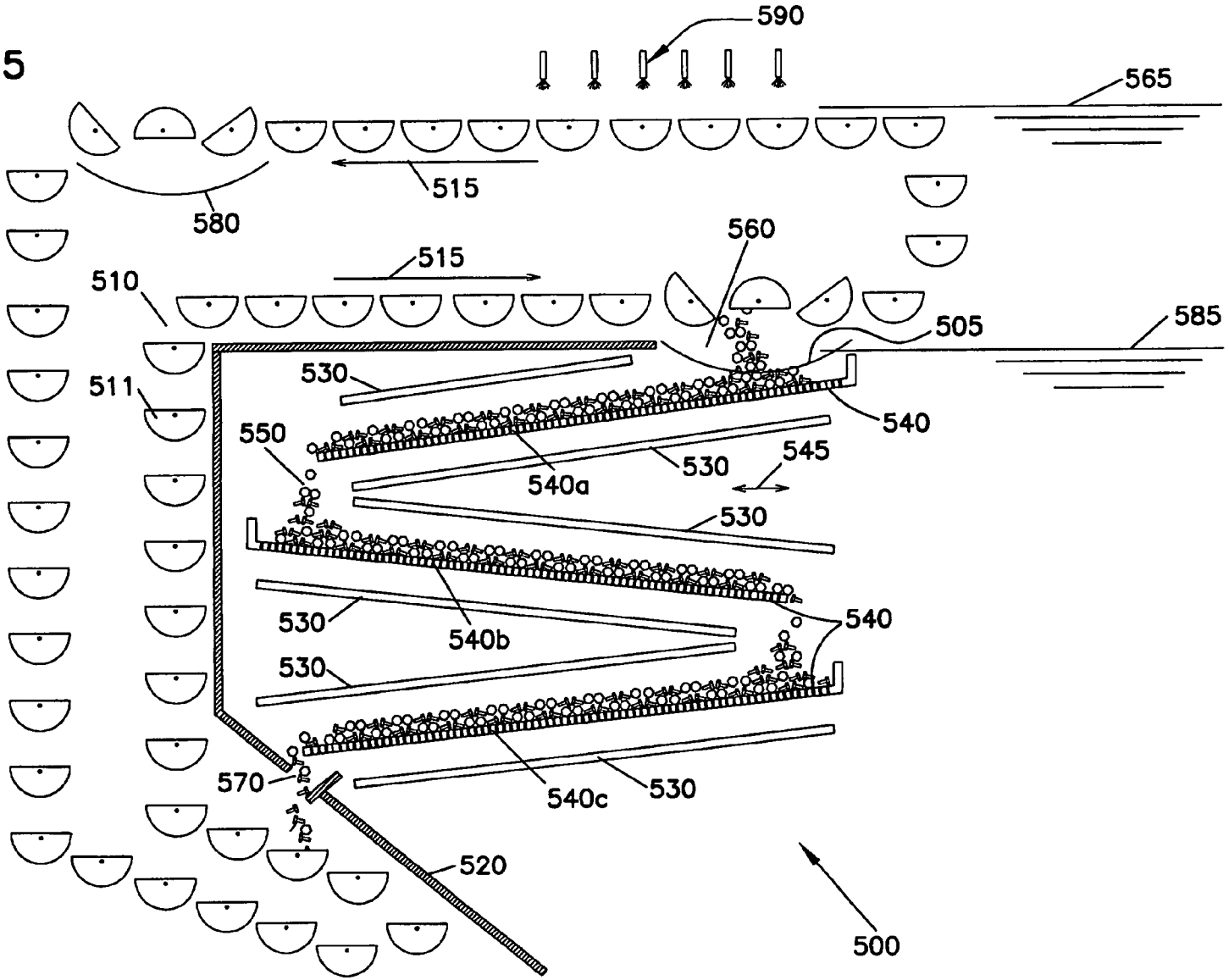
FIG. 5 is a schematic of a bulk plating device for an electroplating process.

FIG. 5 is a schematic of a bulk plating device 500 for an electroplating process 10 (see FIG. 1). Bulk plating presents unique problems due to the pieces to be plated (bulk) may be many small, large volume pieces. An aluminum plating process will plate only the surface of the base metal (or bulk) near the anode. A high throwing power of the electrolyte is advantageous for maximizing plating rate of bulk pieces. The bulk must be mixed continuously to achieve even plating. An aluminum plating system for bulk plating should have a high average plating rate and a low abrasion rate while plating large amounts of small parts.

Sufficient bath agitation results in a minimal diffusion layer around the cathode, which achieves the maximum local current density, for example of 1.3 $A/dm^2$ and hence the maximum local plating rate of 0.64 mils per hour. To maximize plating rate, the bulk should be spread out to provide a large surface for aluminum nucleation. The bulk surface to bulk volume ratio should be high. The bulk surface should also maintain a uniform distance to the anode, so that the maximum local plating rate can be achieved over the largest possible area of the bulk surface, resulting in the highest average plating rate.

Bulk should be mixed carefully with the right tumbling technique to achieve low abrasion rates. If the parts spread out, only slight agitation is necessary to get evenly plated parts. Greater mixing results in better distribution of aluminum on the bulk or parts. Abrasion and mixing should be carefully balanced to get the required plating uniformity and bath agitation.

Bulk plating may be chosen over rack plating after consideration of several considerations:

1. Vary large amounts of very small parts can be cheaper to process with a bulk system due to eliminated racking time.

2. It is possible to plate with a bulk system without unplated contact areas on the part to be plated.
3. Bulk plating provides more uniform plating by rotational exposure of the part to the anode.
4. Holes can be more properly rinsed in the part with bulk plating systems.

Bulk plating can be accomplished with a shaker type bulk plating device 500 shown in FIG. 5. Initially the parts will be fed through the parts entrance 505 into the shaker type bulk plating device 500. The shaker type bulk plating device 500 includes a container chain 510 for conveying bulk 550 into the shaker entrance 560 and for collecting bulk 550 from the shaker exit 570. The container chain 510 can be made of a plurality of containers 511 or other means for transferring bulk 550 from the shaker exit 570 to the shaker entrance 560. The direction of motion of the container chain 510 is shown with arrow 515.

During plating operation, the container chain 510 deposits the bulk 550 into the shaker entrance 560 and collects the bulk 550 from the shaker exit 570 for return to the shaker entrance 560. The electrolyte level 565 may submerse the entire container chain 510 during the plating process. After the bulk 550 is plated, the container chain 510 operations change so that the container chain collects the bulk 550 from the shaker exit 570 and deposits the bulk 550 in the plated parts exit 580. Thus, the container chain 510 will not turn over at the shaker entrance 560 as shown in FIG. 5. The electrolyte level 585 may be lowered below the container chain 510 after the bulk is plated so that a spray rinse 590 can rinse the plated bulk 550 before the plated bulk 550 reaches the plated parts exit 580. The containers 511 are perforated so the rinse 590 liquid can drain to the containers 511 below the top level for increased rinsing as shown in FIG. 5.

The bulk shaker device 500 includes one or more cathodic contact areas 540 that may be a perforated phenolic sheet. The bulk shaker device 500 includes one or more anodes 530. The anodes 530 can be parallel with the cathodic contact areas 540 and may be a sheet. The cathodic contact areas 540 can be between the anodes 530. Screening 520 can be placed around the cathodic contact areas 540 and the anodes 530. The cathodic contact areas 540 and the anodes 530 can be mounted into a frame on wheels that is moving/shaking back and forth with an amplitude shown with arrow 545. The bulk 550 enters the shaker entrance 560 and "shakes" down the cathodic contact areas 540 that may be a perforated phenolic sheet; the bulk 550 may move from a first cathodic contact area 540*a* to a second cathodic contact areas 540*b* to a third cathodic contact areas 540*c* and so on to the shaker exit 570. While on the cathodic contact areas 540 the bulk is plated.

The plating speed of the bulk shaker device 500 may be three times higher than conventional barrel plating systems. The plating time can be 2.25 hours for an average aluminum plate thickness of 0.4 mils for a specific electrolyte with a maximum current density of 1.3 A/dm$^2$. The amount of bulk can be 1000 lbs or more.

EXAMPLES

Any of the electrolytes described herein are made using known techniques. The first step is to mix the dry toluene and dry salt with the solvent. Stir and slowly add (under inert gas) the aluminum alkyls. These should be added in order of their reaction heat, with the compound having the lowest reaction heat being added first. For example, add the old electrolyte first, then the dialkylaluminum halogenide, then TPA, then TEA and then TMA. Heat the mixture to 100° C. and stir for 5 hours to finish the reaction. After that, the electrolyte is ready for either use or for storage. Note that if impure compounds are used, it may be necessary to perform some dummy plating prior to production in order to remove any impurities present in the electrolyte.

Example 1

Table 1 shows electrolyte formulations (A through L) that provide a good balance between throwing power and current density. These formulations are useful for rack plating.

TABLE 1

| | | | | | Al-plating electrolyte with a good balance between throwing power and maximum current density values for concentrations in mol per mol salt | | | | | | | | | | | |
|---|---|---|---|---|---|---|---|---|---|---|---|---|---|---|---|---|
| | | | | | A | B | C | D | E | F | G | H | I | J | K | L |
| Electrolyte | 2:1 complex | Salt for 2:1 complex | Cation | Sodium | | 0.4 | 1 | | | | 1 | 0.2 | | | 1 | 1 |
| | | | | Potassium | 1 | 0.6 | | 0.5 | 1 | 0.9 | | 0.8 | 1 | 0.6 | | |
| | | | | Tetrammonium | | | | 0.5 | | 0.1 | | | | 0.4 | | |
| | | | Anion | Fluoride | 1 | 0.6 | | 0.5 | 1 | 0.9 | | 0.8 | 1 | 0.6 | | |
| | | | | Chloride | | | | 0.5 | | 0.1 | | | | 0.4 | | |
| | | | | Hydride | | 0.4 | 1 | | | | 1 | 0.2 | | | 1 | 1 |
| | | Aluminum-alkyls for 2:1 complex | Tri-methyl-aluminum | | 0.4 | | 0.4 | 0.5 | 0.4 | 0.5 | 0.4 | 0.4 | 0.4 | | 0.2 | |
| | | | Tri-ethyl-aluminum | | | 1.6 | | 1.5 | | 1.5 | | | | 1 | 0.7 | 0.9 |
| | | | Tri-n-propyl-aluminum | | 1.6 | 0.4 | 1.6 | | 1.6 | | 1.6 | 1.6 | 1.6 | 0.6 | 0.8 | 1.1 |
| | | | Tri-iso-butyl-aluminum | | | | | | | | | | | | 0.3 | |
| | | | Di-iso-butyl-aluminum-hydride | | | | | | | | | | | 0.4 | | |
| | Solvent | Toluene | | | | | 2.8 | 4.2 | 4.1 | 4.9 | 2.8 | 4.1 | 4.1 | 4.3 | 5.8 | 5.5 |
| | | Xylene | | | | 4.5 | | | | | | | | | | |
| | | Tetraline | | | 6 | | | | | | | | | | | |
| | Additions | Aluminum-alkyls | Tri-methyl-aluminum | | | | | | | | | | | | | |
| | | | Tri-ethyl-aluminum | | | | | | | | | | | | | |
| | | | Tri-n-propyl-aluminum | | | | | | | | | 0.1 | | | | |
| | | | Tri-iso-butyl-aluminum | | | | | | | | | | | | | |
| | | | Di-iso-butyl-aluminum-hydride | | | | | | | | | | | | | |
| | | | Ethyl-aluminum-di-chloride | | | | | | | | | | | | | |

TABLE 1-continued

| | | | Al-plating electrolyte with a good balance between throwing power and maximum current density values for concentrations in mol per mol salt | | | | | | | | | | | |
|---|---|---|---|---|---|---|---|---|---|---|---|---|---|---|
| | | | A | B | C | D | E | F | G | H | I | J | K | L |
| | Ether | Ethylene-glycole-di-methyl-ether | | | | | | | | | | | | |
| | | Di-ethylene-glycole-di-methyl-ether | | | | | | | | | | | | |
| | | Dioxane | | | | | | | | | | | | |
| | | Anisole | | | | | | | | | | | | |
| | Others | Aluminoxanes | | | | | | | | | | | | |
| | | $R_2Al—O—(C_2H_5—O—)n\ CH_3$ | | | | | | | 0.2 | 0.2 | | | | |
| | | $R_2Al—O—(C_2H_5—O—)n\ AIR_2$ | | | | | | | | | 0.2 | | | |
| | | Di-alkyl-alkoxy-aluminum | | | | | | | | | | | | |

Example 2

Table 2 shows electrolyte formulations (M through T) that provides good throwing power. These formulations are useful for barrel or bulk plating.

TABLE 2

| | | | | | Al-plating electrolyte with a good throwing power values for concentrations in mol per mol salt | | | | | | | |
|---|---|---|---|---|---|---|---|---|---|---|---|---|
| | | | | | M | N | O | P | Q | R | S | T |
| Electrolyte | 2:1 complex | Salt for 2:1 complex | Cation | Sodium | | 0.2 | | | | | 1 | 1 |
| | | | | Potassium | 0.5 | 0.8 | 0.9 | 1 | 0.9 | 0.6 | | |
| | | | | Tetrammonium | 0.5 | | 0.1 | | 0.1 | 0.4 | | |
| | | | Anion | Fluoride | 0.5 | 0.8 | 0.9 | 1 | 0.9 | 0.6 | | |
| | | | | Chloride | 0.5 | | 0.1 | | 0.1 | 0.4 | | |
| | | | | Hydride | | 0.2 | | | | | 1 | 1 |
| | | Aluminum-alkyls for 2:1 complex | Tri-methyl-aluminum | | 0.5 | | 0.5 | 0.4 | 0.5 | | 0.2 | |
| | | | Tri-ethyl-aluminum | | 1.5 | 0.9 | 1.5 | | 1.5 | 1 | 0.7 | 0.9 |
| | | | Tri-n-propyl-aluminum | | | 1.1 | | 1.6 | | 0.6 | 0.8 | 1.1 |
| | | | Tri-iso-butyl-aluminum | | | | | | | | 0.3 | |
| | | | Di-iso-butyl-aluminum-hydride | | | | | | | 0.4 | | |
| | Solvent | Toluene | | | 4.2 | 5.1 | 5.2 | | 4.9 | 4.3 | 5.8 | 5.5 |
| | | Xylene | | | | | | 6 | | | | |
| | | Tetraline | | | | | | | | | | |
| | Additions | Aluminum-alkyls | Tri-methyl-aluminum | | | | | | | | | |
| | | | Tri-ethyl-aluminum | | | | | | 0.2 | | | |
| | | | Tri-n-propyl-aluminum | | | | | 0.4 | | | | |
| | | | Tri-iso-butyl-aluminum | | | | | | | | | |
| | | | Di-iso-butyl-aluminum-hydride | | | | | | | | | |
| | | | Ethyl-aluminum-di-chloride | | | | | 0.05 | | | | |
| | | Ether | Ethylene-glycole-di-methyl-ether | | | | 0.2 | 0.3 | | | | |
| | | | Di-ethylene-glycole-di-methyl-ether | | | | | | | | | |
| | | | Dioxane | | | | | | | | 0.1 | |
| | | | Anisole | | | | | | 0.4 | | | |
| | | Others | Aluminoxanes | | | | | | | | | |
| | | | $R_2Al—O—(C_2H_5—O—)n\ CH_3$ | | 0.2 | 0.2 | | | 0.2 | | | 0.3 |
| | | | $R_2Al—O—(C_2H_5—O—)n\ AIR_2$ | | | | | | | 0.3 | | |
| | | | Di-alkyl-alkoxy-aluminum | | | | | | | | | |

Example 3

Table 3 shows electrolyte formulations (U through CC) that provides high current density. These formulations provide fast plating via high current density and are useful for continuous plating and the purification of aluminum.

TABLE 3

| | | | | | Al-plating electrolyte with a high maximum current density values for concentrations in mol per mol salt | | | | | | | | |
|---|---|---|---|---|---|---|---|---|---|---|---|---|---|
| | | | | | U | V | W | X | Y | Z | AA | BB | CC |
| Electrolyte | 2:1 complex | Salt for 2:1 complex | Cation | Sodium | | | | | | | | 0.2 | 1 |
| | | | | Potassium | 1 | 0.7 | 0.7 | 1 | 0.7 | 1 | 1 | 0.8 | |
| | | | | Tetrammonium | | 0.3 | 0.3 | | 0.3 | | | | |
| | | | Anion | Fluoride | 1 | 0.7 | 0.7 | 1 | 0.7 | 1 | 1 | 0.8 | |
| | | | | Chloride | | 0.3 | 0.3 | | 0.3 | | | | |
| | | | | Hydride | | | | | | | | 0.2 | 1 |
| | | Aluminum-alkyls for 2:1 complex | Tri-methyl-aluminum | | 0.2 | | | | | | | | |
| | | | Tri-ethyl-aluminum | | 0.3 | 0.3 | 0.3 | 0.3 | 0.3 | 0.3 | 0.3 | 0.8 | 0.4 |
| | | | Tri-n-propyl-aluminum | | 1.5 | 1.7 | 1.7 | 1.7 | 1.7 | 1.7 | 1.7 | 1.2 | 1.6 |
| | | | Tri-iso-butyl-aluminum | | | | | | | | | | |
| | | | Di-iso-butyl-aluminum-hydride | | | | | | | | | | |
| | Solvent | Toluene | | | 4 | 3.8 | 4.1 | 4.1 | 4.1 | 4.5 | 4.5 | 3 | 3.4 |
| | | Xylene | | | | | | | | | | | |
| | | Tetraline | | | | | | | | | | | |
| | Additions | Aluminum-alkyls | Tri-methyl-aluminum | | | | | | | | | | |
| | | | Tri-ethyl-aluminum | | 0.3 | 0.5 | 0.5 | 0.4 | 0.4 | 0.4 | 0.4 | 0.2 | |
| | | | Tri-n-propyl-aluminum | | 0.3 | | | | | 0.1 | 0.1 | 0.3 | 0.4 |
| | | | Tri-iso-butyl-aluminum | | | | | | 0.1 | | | | |
| | | | Di-iso-butyl-aluminum-hydride | | | | | 0.2 | | | | | |
| | | | Ethyl-aluminum-di-chloride | | | | 0.1 | | | | | | |
| | | Ether | Ethylene-glycole-di-methyl-ether | | | | | | 0.4 | | | 0.2 | |
| | | | Di-ethylene-glycole-di-methyl-ether | | | | | 0.5 | | | | | |
| | | | Dioxane | | | | | | | | | | 0.3 |
| | | | Anisole | | | | 0.5 | | | | | | |
| | | Others | Aluminoxanes | | | | | | | | | | |
| | | | $R_2Al—O—(C_2H_5—O—)n\ CH_3$ | | 0.3 | | | | | 0.35 | | 0.3 | |
| | | | $R_2Al—O—(C_2H_5—O—)n\ AIR_2$ | | | 0.25 | | | | | 0.2 | | |
| | | | Di-alkyl-alkoxy-aluminum | | | | | | | | | | |

In these formulations, an excess of aluminum alkyl provides higher current densities but also provides for a rougher precipitation (Al-layer) and lower throwing power. Anisol or other ethers; alkoxy compounds such as, for example; $R^{25}Al—O—(C_2H_4—O—)_q—Al—R_2^5$ or $R^{25}Al—O—(C_2H_4—O—)_q—R^5$ where q and $R^5$ is previously defined; aluminoxanes; dialkylaluminum halogenide compounds can be used to combat these negative effects. These formulations result in a maximum current density that is increased by more than 100% compared with the values achieved with a specific electrolyte with a maximum current density of 1.3 A/dm2.

Example 4

The next set of formulations describe a magnesium/aluminum electroplating electrolyte that provides high current density. It has been found that an improved electrolyte can be developed by replacing QEA as the main aluminum alkyl with another aluminum alkyl like QPA, QMA, QiBA or mixtures thereof. Preferred formulations (DD through MM) are provided in Table 4 below.

TABLE 4

| | | | | Al and Mg/Al-plating electrolyte values for concentrations in mol per mol cation | | | | | | | | | |
|---|---|---|---|---|---|---|---|---|---|---|---|---|---|
| | | | | DD | EE | FF | GG | HH | II | JJ | KK | LL | MM |
| Electrolyte | Complex | Cation | Sodium | 0.1 | 0.2 | 0.09 | 0.12 | 0.2 | 0.2 | 1 | 1 | 1 | 1 |
| | | | Potassium | 0.9 | 0.8 | 0.91 | 0.88 | 0.8 | 0.8 | | | | |
| | | Anion | $(Al(CH_3)_4)^-$ | | 0.2 | | | | | | | | 0.1 |
| | | | $(Al(C_2H_5)_4)^-$ | 0.4 | 0.3 | 0.4 | 0.4 | 0.3 | 0.2 | | 0.15 | 0.1 | |
| | | | $(Al(C_3H_7)_4)^-$ | 0.6 | 0.5 | 0.5 | 0.6 | 0.5 | 0.4 | 0.33 | 0.18 | 0.1 | 0.9 |
| | | | $(Al(C_4H_8)_4)^-$ | | | 0.1 | | | 0.4 | | | 0.13 | |
| | | | $(AIRH(C_4H_9)_2)^-$ | | | | | 0.2 | | | | | |
| | | | $((CH_3)_3Al—H—Al(CH_3)_3)^-$ | | | | | | | | | | 0.1 |
| | | | $((C_2H_5)_3Al—H—Al(C_2H_5)_3)^-$ | | | | | | | | 0.3 | 0.2 | |
| | | | $((C_3H_7)_3Al—H—Al(C_3H_7)_3)^-$ | | | | | | | 0.67 | 0.36 | 0.2 | 0.9 |
| | | | $((C_4H_9)_3Al—H—Al(C_4H_9)_3)^-$ | | | | | | | | | 0.26 | |
| | | | $((C_4H_9)_3Al—H—AIH(C_4H_9)_2)^-$ | | | | | | | | | | |

TABLE 4-continued

| | | | Al and Mg/Al-plating electrolyte values for concentrations in mol per mol cation | | | | | | | | | |
|---|---|---|---|---|---|---|---|---|---|---|---|---|
| | | | DD | EE | FF | GG | HH | II | JJ | KK | LL | MM |
| Solvent | Toluene | | 5.5 | 6.5 | 6 | 5.3 | 6.5 | 5.5 | 2.8 | 3 | | |
| | Xylene | | | | | | | | | | | 4.1 |
| | Tetraline | | | | | | | | | | 5.4 | |
| Additions | Aluminum-alkyls | Tri-methyl-aluminum | | 0.4 | | | | | | | | 0.2 |
| | | Tri-ethyl-aluminum | 0.7 | 0.6 | 0.8 | 0.7 | 0.6 | 0.4 | | 0.3 | 0.2 | |
| | | Tri-n-propyl-aluminum | 1.4 | 1 | 1 | 1.4 | 1 | 0.8 | 0.67 | 0.36 | 0.2 | 1.8 |
| | | Tri-iso-butyl-aluminum | | | 0.2 | | | 0.8 | | | 0.26 | |
| | | Di-iso-butyl-aluminum-hydride | | | | | 0.4 | | | | | |
| | Ether | Ethylene-glycole-di-methyl-ether | | | | | | | | | | |
| | | Di-ethylene-glycole-di-methyl-ether | | 0.2 | | | | | | | | |
| | | Dioxane | | | | | | | | | | |
| | | Anisole | | | | | | | | | | |
| | Others | Aluminoxanes | | | | | | | | | | |
| | | $R_2Al—O—(C_2H_5—O—)n\ CH_3$ | | | | 0.1 | | | | | | |
| | | $R_2Al—O—(C_2H_5—O—)n\ AlR_2$ | | | | | | | | | 0.1 | |
| | | Di-alkyl-alkoxy-aluminum | | | | | | | | | | |

These formulations employ TPA, TIBA and/or TMA as the main compound, rather than TEA. We have found that this results in a higher throwing power and a higher current density.

I claim:

1. An electroplating composition comprising:

(a) $CA•(nAl(C_3H_7)_3(2-n)AlR_3)$ wherein:

n is 0 to 2;

C is Li, Na, K, Rb, Cs, $NR^14$, or mixtures thereof, in which $R^1$ is $C_1$-$C_8$ alkyl, or mixtures thereof A is H, F, Cl, Br or mixtures thereof;

R is H, halogen, $C_1$-$C_8$ alkyl, or mixtures thereof;

(b) one or more of (i) an aluminum alkyl compound of the formula $R_1AlR_2$ wherein R is as defined above and $R^1$ is a $C_1$-$C_8$ alkyl group;

(ii) an alkoxy aluminum compound of the formula $R^5{}_2Al(OR^5)_{3-p}$, where p is 0, 1 or 2 and $R^5$ is a $C_1$-$C_8$ alkyl;

(iii) an alkoxy aluminum alkyl compound of the formula $R^5{}_2Al—O—(C_2H_4O)_q—AlR^5{}_2$ or $R^5{}_2Al—O—(C_2H_4O)_q—R^5$, where $R^5$ is as defined above and q is 1, 2, 3 or 4; or (iv) an aluminoxane compound of the formula $R_4{}_2Al—(O—AlR^4{}_2)_m—OAlR^4{}_2$ or $(R^4AlO)_n$ where m is an integer from 1-8, n is an integer from 3-8, and $R^4$ is a $C_1$-$C_8$ alkyl;

and (c) an aromatic hydrocarbon, aliphatic hydrocarbon or mixtures thereof.

2. The composition according to claim 1, wherein (b) is an aluminum alkyl of the formula $R^1AlR_2$.

3. The composition according to claim 2, wherein R is $CH_3$, $C_2H_5$, $C_3H_7$, $C_4H_9$ or mixtures thereof.

4. The composition according to claim 3, wherein R is $C_3H_7$.

5. The composition according to claim 1, wherein (b) is an aluminoxane of the formula $R^4{}_2Al—(O—AlR^4{}_2)_m—OAlR^4{}_2$ or $(R^4AlO)_n$ where m is an integer from 1-8, n is an integer from 3-8, and $R^4$ is a $C_1$-$C_8$ alkyl.

6. The composition according to claim 5, wherein $R^4$ is $CH_3$, $C_2H_5$, $C_3H_7$, $C_4H_9$, or mixtures thereof.

7. The composition according to claim 1, wherein (b) is an alkoxy aluminum compound of the formula $R^5{}_2Al(OR^5)_{3-p}$, where p is 0, 1 or 2 and $R^5$ is a $C_1$-$C_8$ alkyl, or mixtures thereof.

8. The composition according to claim 1, wherein (b) is an alkoxy aluminum compound of the formula $R_5{}_2Al—O—(C_2H_4O)_q—AlR^5{}_2$ or $R^5{}_2Al—O—(C_2H_4O)_q—R^5$, where $R^5$ is as defined above and q is 1, 2, 3 or 4, or mixtures thereof.

9. The composition according to claim 1, wherein:

(a) C is 1M K;

A is 1M F;

n is 1.6;

R is $CH_3$;

(b) a mixture of (i) aluminum alkyls, where R and R' are $C_3H_7$ and R' is $C_2H_5$ and R is Cl, and (ii) an ether being ethylene-glycol-dimethylether; and (c) the aromatic hydrocarbon is xylene.

10. The composition according to claim 1, wherein:

(a) C is 0.9M K and 0.1M tetraalkylammonium;

A is 0.9M F and 0.1 M Cl;

n is 0;

R is $CH_3$ and $C_2H_5$;

(b) a mixture of (i) an aluminum alkyl where R and $R^1$ are $C_2H_5$ (ii) the ether is anisole, and (iv) a compound of the formula $R^5{}_2Al—O—(C_2H_5O)_qCH_3$ and (c) the aromatic hydrocarbon is toluene.

11. The composition according to claim 1, wherein:

(a) C is 1M K;

A is 1M F;

n is 1.5;

R is $CH_3$ and $C_2H_5$ (b) a compound of the formula $R^5{}_2AlO—(C_2H_5O)_q—CH_3$; and (c) the aromatic hydrocarbon is toluene.

12. The composition according to claim 1, wherein:

(a) C is 0.7M K and 0.3M tetraalkylammonium;

A is 0.7M F and 0.3M Cl;

n is 1.7;

R is $C_2H_5$ (b) a mixture of (i) aluminum alkyls, where $R^1$ is $C_2H_5$ and R is Cl and $R^1$ and R are $C_2H_5$, and (ii) an ether being anisole; and (c) the aromatic hydrocarbon is toluene.

13. The composition according to claim 1, wherein:

(a) C is 0.7M K and 0.3M tetraalkylammonium;

A is 0.7M F and 0.3M Cl;

n is 1.7;

R is $C_2H_5$ (b) a mixture of (i) aluminum alkyls, where R and $R^1$ are $C_2H_5$ and R and $R^1$ are isobutyl, and (ii) an ether being ethylene-glycol-dimethylether; and (c) the aromatic hydrocarbon being toluene.

* * * * *